United States Patent [19]

Jacobson

[11] 4,105,182

[45] Aug. 8, 1978

[54] MULTIPLE USE STUDY DEVICE

[76] Inventor: Samuel O. Jacobson, 11255 Gaviota Ave., Granada Hills, Calif. 91344

[21] Appl. No.: 758,594

[22] Filed: Jan. 12, 1977

[51] Int. Cl.[2] ..... A47B 97/08

[52] U.S. Cl. ..... 248/459; 211/42; 248/174

[58] Field of Search ..... 248/459, 460, 472, 174, 248/451, 455, 450, 445; 281/45, 33; 211/42, 73

[56] References Cited

U.S. PATENT DOCUMENTS

| | | | |
|---|---|---|---|
| 1,312,379 | 8/1919 | Adams | 211/42 X |
| 2,222,665 | 11/1940 | Hoenigsberg | 248/459 |
| 2,252,571 | 8/1941 | Kohn | 248/459 |
| 2,490,356 | 12/1949 | Hummel | 281/33 X |
| 2,726,835 | 12/1955 | Hummell | 248/459 |
| 3,041,774 | 7/1962 | Walker | 248/460 X |
| 3,207,320 | 9/1965 | Nichols | 248/459 X |
| 3,305,205 | 2/1967 | Frankl | 248/459 |
| 3,450,420 | 6/1969 | Smith | 281/33 |
| 3,620,552 | 11/1971 | Woodcock et al. | 281/33 |
| 3,990,669 | 11/1976 | Smith | 248/459 |

FOREIGN PATENT DOCUMENTS

| | | | |
|---|---|---|---|
| 2,444,180 | 3/1976 | Fed. Rep. of Germany | 248/472 |
| 1,495 of | 1909 | United Kingdom | 248/455 |

*Primary Examiner*—Rodney H. Bonck

[57] ABSTRACT

A collapsible and portable bookstand, formed from a single elongated blank of light weight material, such as cardboard, transversely creased to form a plurality of foldable panels which are adapted to lock into a plurality of positions each of which is adapted for a different purpose such as holding and supporting an opened book in a rearwardly inclined position for ease of viewing, for use as a cover or support, for use as a folder for notepads, a hand-held support for such items as a note or sketch pad, a storage bin for books or like articles, a bookrack, a pen-pencil and ruler holder, a lectern, a study carrel, a clipboard easel for typists, a music stand, a projection screen prop or a technical drawing board prop.

8 Claims, 20 Drawing Figures

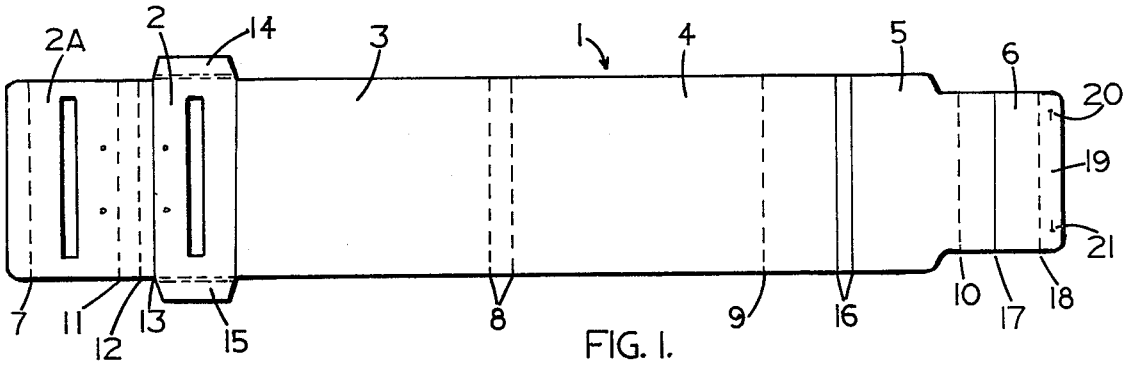
FIG. 1.
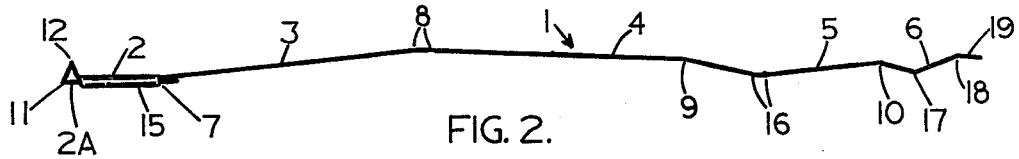
FIG. 2.
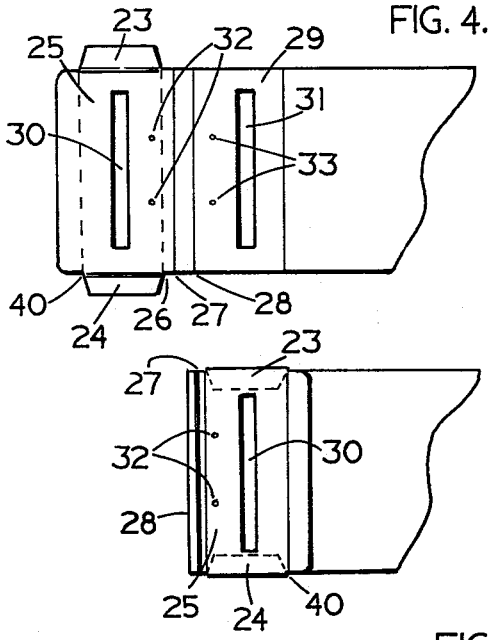
FIG. 4.
FIG. 5.
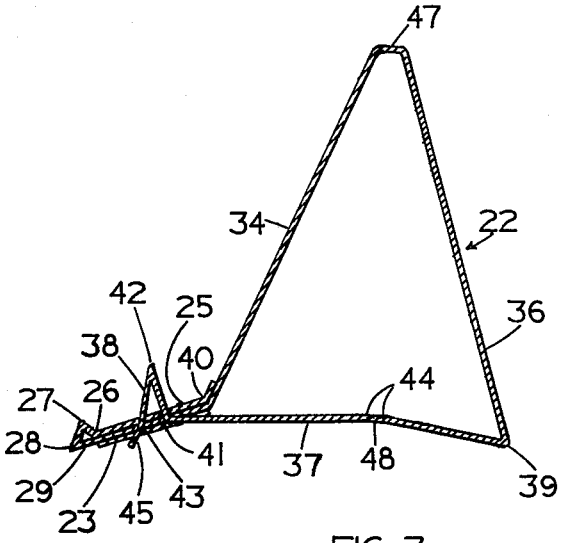
FIG. 3.

MULTIPLE USE STUDY DEVICE

BACKGROUND OF THE INVENTION

A variety of collapsible display stands exist in the prior art such as the display stand described in the patent issued to R. S. Hummel, U.S. Pat. No. 2,726,835. These prior art display stands suffer from a variety of problems which makes them impractical for use by a student or teacher. For instance, the display stand described by Hummel is utilizeable in a variety of shapes, as he has described, solely for a display stand on which can be rested a variety of objects but the display stand can be used only in one position that is the folded position described when the display stand is set up. In each of these positions a raised tab, which is used to support the stand, is located on the relatively horizontal panel which supports the display or books. These raised tabs, in the position shown, make it impossible to use the display stand as a bookrest for someone using a book because it is quite difficult to turn the pages against these raised tabs. In addition, as previously stated, the display stands as previously known have one use and one use only; that is to rest an object against the backward leaning display rack.

It is an object of the present invention to provide a convenient easel-like support for an open book or similiar object and yet provide a support which is quickly collapsible for storage or transport.

It is still another object of this present invention to provide a stand which serves in a multiple-use manner such as a holder, carrier and organizer of book related tools and materials depending upon the particular manner in which the device is folded.

It is yet another object of the invention to provide a sturdy, light weight, simple in design, easy to construct, inexpensive to manufacture bookstand which is utilizeable in a variety of manners.

Figure 6:
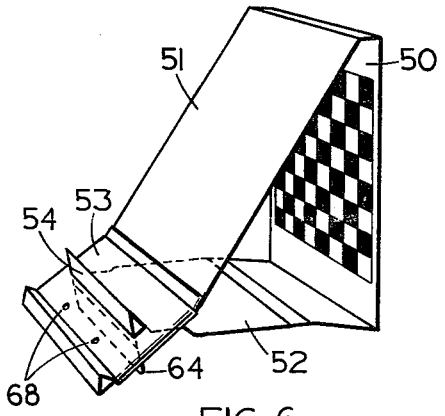
Figure 7:
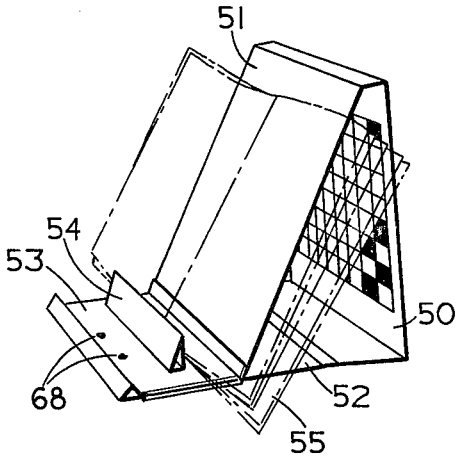
Figure 8:
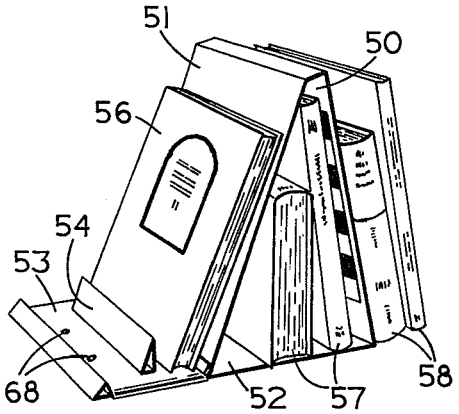
Figure 9:
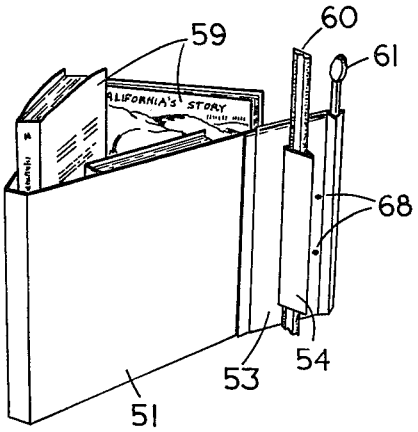
Figure 10:
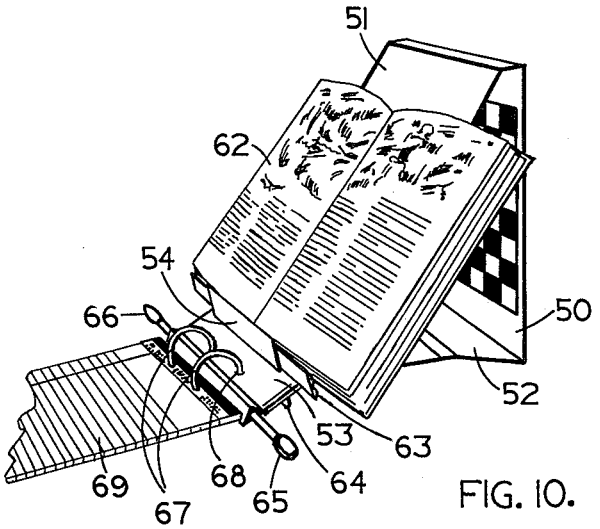
Figure 11:
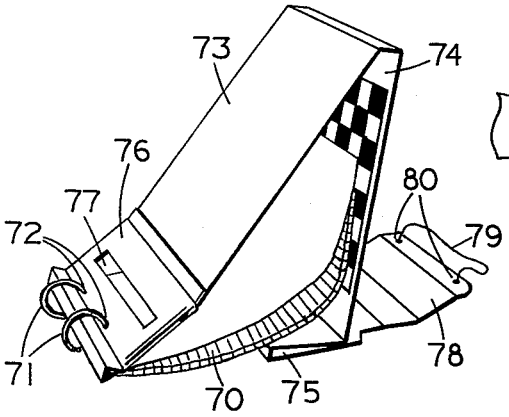
Figure 12:
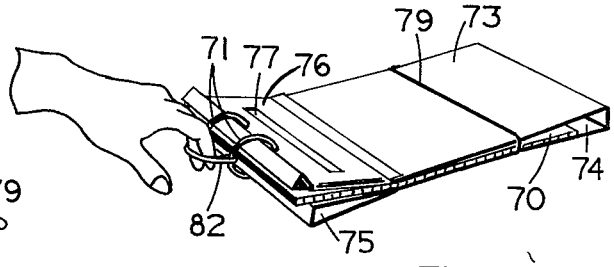
Figure 13:
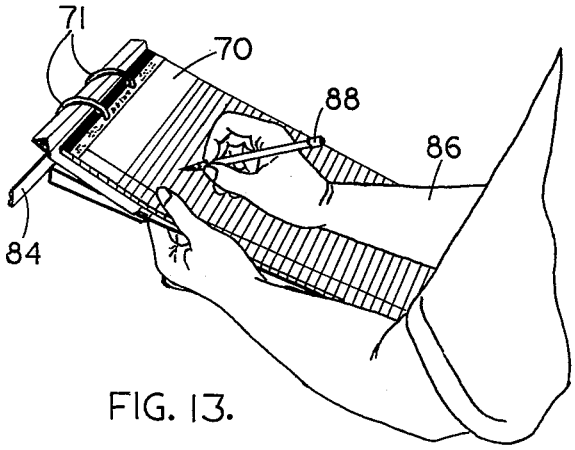
Figure 14:
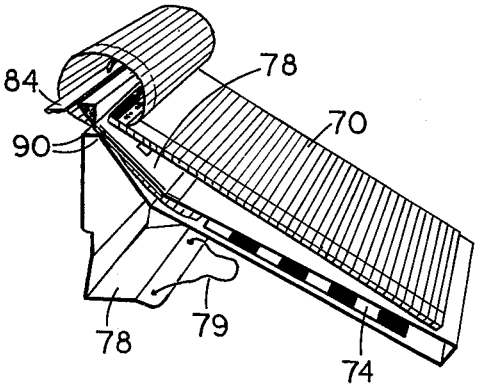
Figure 15:
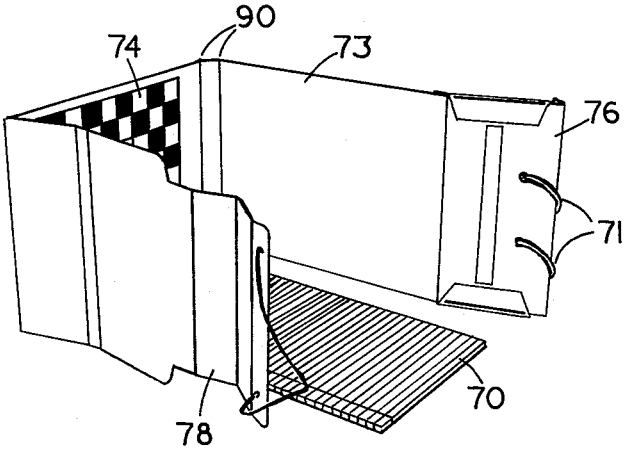
Figure 16:
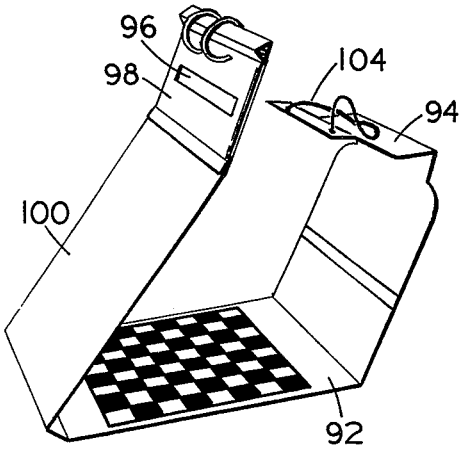
Figure 17:
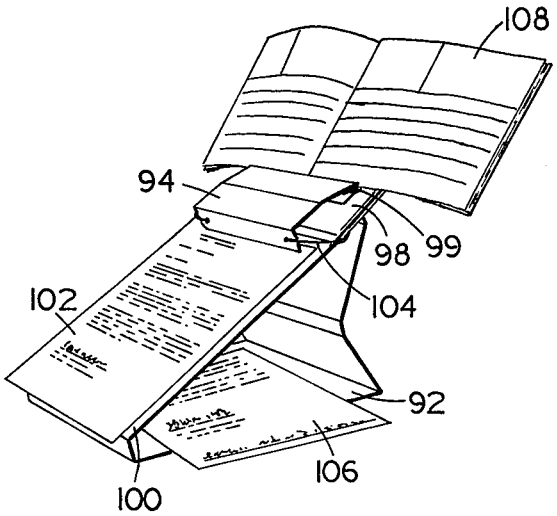
Figure 18:
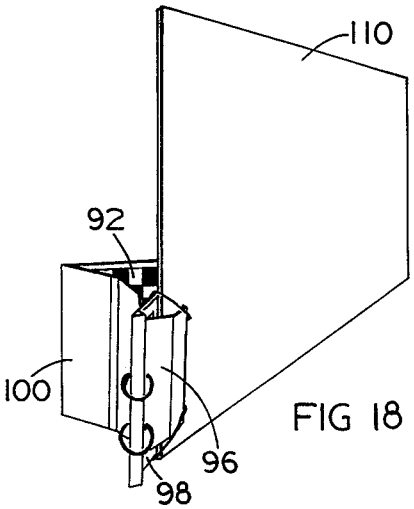
Figure 19:
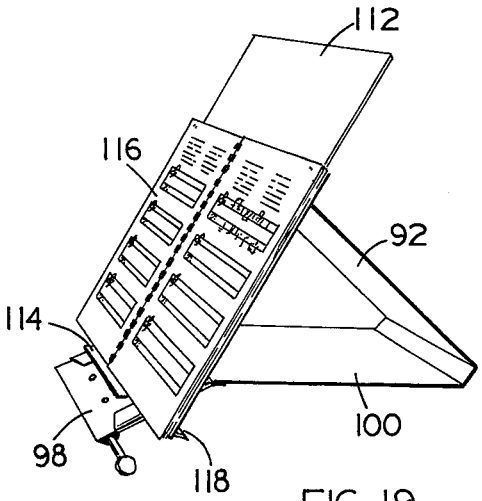
Figure 20:
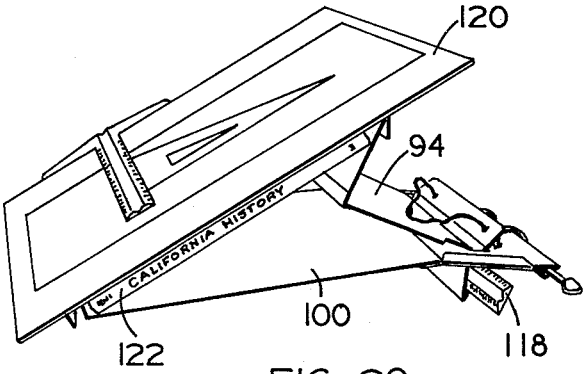

Other and further features and objects of this invention will become apparent from an analysis of the following specification given in conjunction with the following drawings in which:

FIG. 1 is a plan view of the blank of the present invention,

FIG. 2 is a side view of the blank of the present invention showing its folding plan and forward assembly structure, FIG. 3 is a central vertical longitudinal sectional view of the invention in the set-up position, FIG. 4 is a plan view of the forward portion of the device comprising a second form of the blank, FIG. 5 is a view of the forward section of the blank showing the assembly of that section, FIG. 6 is a perspective view of the device, FIG. 7 is a perspective view showing the device supporting a book, FIG. 8 is a perspective view illustrating the device as a bookrack, FIG. 9 is a perspective view illustrating the device as a book, storage bin, and article holder, FIG. 10 is a perspective view showing an alternate position of the bookstand and illustrating the device's use as a holder of book-related objects, FIG. 11 is a perspective view illustrating the method used for folding the blank into a closed position, FIG. 12 is a perspective view illustrating one method by which the closed device can be carried to act as a note pad folder, FIG. 13 is a perspective view illustrating the use of the device as a ruler and notepad holder, FIG. 14 is a perspective view illustrating the use of the device as a prop or lectern, FIG. 15 is a perspective view illustrating the use of the device as a carrel, FIG. 16 is a perspective view illustrating the use of the device as a gameboard surface, FIG. 17 is a perspective view illustrating the device's use as a clipboard, easel, or pamphlet holder, FIG. 18 is a perspective view illustrating the use of the device to prop and hold vertically a non-collapsible projection screen or the like, FIG. 19 is a perspective view illustrating the device as a music stand, and FIG. 20 is a perspective view illustrating the device used to prop a technical drawing board and materials.

Referring now to the drawings, there is shown in FIGS. 1 and 2 the elongated blank of the present invention. The elongated blank 1 is comprised of basic sections or panels 2, 3, 4, 5 and 6 which are formed by creases along crease lines 7, 8, 9 and 10. The solid lines indicate creases on the top of the blank and the dotted lines creases underneath so that the blank will fold properly. Panel 2 is reinforced when creases 11, 12 and 13 allow the blank's forward end 2A to be folded and permanently attached such as with glue to the underside of the blank as shown in FIG. 2. Further stability at the sides results when tabs 14 and 15 are folded under and fixedly attached such as by glue or otherwise to the underside of the blank to form a tray panel. Crease lines 16 allows panel 5 to be collapsible. A pagestop-bookshelf panel results when panel 6 is folded at crease lines 10, 17 and 18. End panel 19 contains two slots 20, 21 which are cut through end panel 19 for attaching various related useful devices such as an elastic band shown in later drawings.

Referring now to FIGS. 3, 4 and 5, there is shown a second form of the blank 22 in which tabs 23 and 24 are located on the forward panel 25. Crease lines 26, 27 and 28 allow the forward section 25 to be folded upward and secured by glue or otherwise held to the top section of the blank 29. Tabs 23 and 24 are bent downward and secured to the underside of blank 29 to provide further stability.

Slots 30 and 31 are aligned to form one slot, after the blank is folded, through the tray panel 25–29. In addition, holes 32 and 33 are aligned so that they match up when the device is folded into the set-up position.

The blank of the present invention is described by the five basic sections or panels including; the tray panel formed by the folding and affixing of panels 29 and 25, a back panel 34, a prop panel 36, a base panel 37 and a pagestop-bookshelf panel 38.

An important feature of the present invention is the arched position as shown between tray panel 25–29 and base panel 37 between folds 28 and 39. This arching occurs when pagestop-bookshelf panel 38 is inserted through slots 30 and 31 and is a result of the spring like tension created by the folds 40, 41, 42 and 43 and the folds 44. End panel 45 acts as a prop for tray 25–29. The triangular shaped structure of tray panel 25–29 resulting from folds 26, 27 and 28 strengthens that leading edge forming a stop for articles layed on the tray panel 25–29 between the folds 26 and 27 and at pagestop-bookshelf 38. The device also functions as a pen or pencil holder as illustrated in later drawings. Loose leaf rings can be inserted through holes 32, 33 for uses as later shown.

Panels 47 and 48 act as spacers for lessening the angles of bend of the respective folds when the device is folded down to a portable position as later shown.

It should be noted that the basic function and design of the invention is not changed by the manner in which the blanks forward panel is fashioned as illustrated in FIG. 1 as compared to that illustrated in FIG. 4.

Referring now to FIGS. 6 through 10, there is shown panel 50 having a surface on which a game of checkers or chess could be played. There is shown the back panel 51, the base panel 52, the prop panel 50, the tray panel 53 and the pagestop-bookshelf panel 54.

FIG. 7 illustrates an open book 55 which is supported in a rearwardly inclined position and whereby its pages are held open by the pagestop-bookshelf panel 54. The book's weight causes the base panel 52 and tray panel 53 to be flush against the supportive table or desk surface on which the device rests.

FIG. 8 illustrates the use of the device as a bookrack where, by placing the weight of a book 56 on tray panel 53 and/or placing various books 57 on base panel 52 to keep the device stationary, a great number of books such as a set of encyclopedia 58 can be leaned or stacked against the outer surface of the prop panel 50.

FIG. 9 illustrates how the device of the invention can be set on its side and be used as a bin for books 59 or other articles as well. To hold the device together in this position, a ruler 60 or like object must be inserted between tray panel 53 and pagestop-bookshelf panel 54. The triangular shaped hole of tray panel 53 can hold a pencil 61 or other device in a secure position.

Referring now to FIG. 10, there is illustrated how the pagestop-bookshelf panel 54 can be used to shelve a book 62 so that the pages of the book can be easily turned. This is an extremely important feature of the device of the present invention in that a party using the device may wish to simply have the book opened to a particular page so that it can be referred to, with the pages held tightly down, as shown in FIG. 7. However, a person may also want to use the device of the present invention as a stand for reading and in this case they will want to be able to easily turn the pages as they are reading. The setup in FIG. 10 allows this to happen. In this position the base panel 52 and the tray panel 53 are in an arched position relative to the table surface and the book 62 is at a greater angle of rearward tilt. Ruler 63 is shown in the slot formed by pagestop-bookshelf panel 54 but it is not required for holding the device together while the book 62 is so positioned. End panel 64 helps in supporting the weight of book 62. A pencil 65 and a pen 66 are tightly held in the slot of tray panel 53. Two loose-leaf rings 67 are attached through holes 68 in tray panel 53 and can be used to hold various devices such as a note pad 69.

Referring now to FIGS. 11 through 15, there is shown the device of the present invention in a method by which the device can be folded down to the closed or portable position. A notepad 70 is pivoted by means of loose-leaf rings 71, inserted into holes 72.

There is shown the back panel 73, the prop panel 74, the base panel 75, the tray panel 76 with slot 77; however, the pagestop-bookshelf panel 78 is not folded and pushed through slot 77 but is folded backwards behind prop panel 74 so that the device can be flattened to the closed or portable position capable of holding pages such as the note pad 70. This is clearly shown in FIG. 12 where the device is in a fully closed position and held closed by an elastic band 79 which is attached through holes 80 in pagestop-bookshelf panel 78. The device can be easily be carried by placing an elastic band 82 around loose-leaf rings 71.

Referring to FIG. 13, a ruler 84 with two holes and rings 71 inserted through these holes can replace the rubber band 82 of FIG. 12 as a handle to carry the device. FIG. 13 shows the device as a hand held note pad carrier so that a person 86 can easily write on a pad 70 with a pencil 88.

FIG. 14 demonstrates that pages of note pad 70 can be held out of the way and fastened down by clipping the pages between panel 78 and prop panel 74.

A desk or table lectern for the note pad 70 can be made when pagestop-bookshelf panel 78 is folded downward by means of creases 90 and then rested on a supportive surface.

FIG. 15 illustrates how teachers or students can use the device as a carrel.

FIG. 16 merely illustrates the use of the device as a game board surface in which the prop panel 92 contains a checker or chess board.

FIG. 17 illustrates the use of the invention as a clipboard and easel for typists which is created by slipping panel 94 forward through slot 96 in panel 98 and placing it on panel 100. Papers 102 or other copiest materials can be held firmly in place by the downward pressure caused by elastic band 104 stretched around and behind panel 98. The papers 106 removed from the clipboard arrangement of the device can be stored on panel 92. A small pamphlet 108 or the like, can be propped against panel 98 if desired as shown which gives further use of the invention as the typist's aid.

FIG. 18 demonstrates the use of the device as a clipboard easel. By laying the device as set-up in FIG. 17 on its side, it can be used to prop up and hold vertically a non-collapsible projection screen 110 or like objects. The projection screen 110 is held by the gripping action between panels 94 and 98.

FIG. 19 demonstrates the use of the invention as a base for propping a lightweight board 112. Panel 100 forms the base and panel 92 is the prop panel to hold the device in a standing position. End panel 114, which protrudes from the underside of tray panel 98, acts as a shelf for board 112 and music book 116. Shelf 114 allows the pages of the music book 116 to be easily and quickly turned. A ruler 118 is used to hold the device together in this position.

Referring now to FIG. 20, there is shown the device held together by ruler 118 holding a drawing board 120. A book 122 of the proper size or a like object of the proper size is wedged between panels 100, 94 and 92, not seen, to prevent the device from collapsing and to maintain the proper angle of tilt for the drawing board 120.

As can be seen from the above description the device of the present invention relates to a collapsible and portable bookstand designed and constructed to hold, carry, and organize book related tools and materials in a variety of manners. Generally, the device consists of an elongated blank of cardboard, plastic, or other suitable material transversely scored or otherwise weakened so as to form a plurality of panels which by folding into the set-up position is then triangularly shaped and capable of supporting an open book or like objects rewardly tilted for ease of viewing. When folded, the blank forms five basic sections of panels: the forward panel being a slotted tray on which a book to be viewed is set, a back panel to hold the book rewardly tilted, a support panel to prop the back panel, a collapsible base panel, and a bendable pagestop-bookshelf panel which can be inserted through the slotted tray panel.

Important features of this invention as described above are that the tray panel is reinforced for extra stability and can simultaneously contain heavy books or other book related tools and materials. When in the set-up or book holding position, the spring like action of the device's fold in relation to said base an pagestop-bookshelf panel allow a book's pages to be held open or, as a result of the arching capability of the base panel connected to the tray panel, the device can be set up so that the pages of the book can be easily turned. The design of the device allows for a minimum angle of bend at the folds and therefore increases the durability of the device when it is made of cardboard.

It will be readily apparent to those skilled in the art that many minor modifications regarding the choice of construction materials, structure design, dimensions, and uses can be incorporated without departing from the original concept of this invention or the scope of the appended claims.

I claim:

1. A multiple use study device for holding a plurality of articles comprising a single elongated blank of relatively stiff material scored along a plurality of transverse parallel lines so as to be foldable and to hingedly connect a plurality of panels at their contiguous edges, said blank having a first narrow end flap panel portion connected at one end by a first bottom-side crease to one end of a second panel portion, said second portion containing a centrally located, transverse slot, said second portion's other end connected to one end of a third panel portion by a second bottom-side crease, said third portion containing a third bottom-side crease with its other end connected to one end of a fourth panel portion by a fourth top-side crease, said fourth portion containing a centrally located slot cut therethrough, said fourth portion slot located in parallel and longitudinal alignment with said second portion slot, said fourth portion containing outwardly extending tabs at its respective sides each of which contain double bottom-side creases scored in parallel alignment with said fourth panel portion's sides, said second portion's bottom side permanently attachable to said fourth portion's bottom side to form a double thickness tray panel wherein said second portion slot is contiguous with said fourth portion slot, said tray panel reinforced with a third thickness at its sides by said tabs' bottom sides permanently attachable to said tray panel's bottom side, said tray panel structure further reinforced by a triangular tubelike configuration through its forward end formed from said third panel portion, its other end containing a fifth top-side crease which connects to one end a rearwardly inclinable back panel, said first narrow end flap panel portion overlapping and permanently attachable to one end of said back panel's bottom-side wherein said first crease is contiguous with said fifth crease, said back panel's other end connected to one end of a forwardly inclinable prop panel by a narrow panel defined by a pair of spaced bottom-side creases, said prop panel terminating at its other end in a bottom-side crease which connects to one end of a base panel, said base panel bisected with a narrow panel defined by a pair of spaced top-side creases thus permitting said base panel to be collapsible, said base panel terminating at its other end in outwardly extending, laterally inwardly directed cuts from said blank's sides to connect with one end of an outwardly extending, parallel sided, pagestop-bookshelf panel, said pagestop-bookshelf panel laterally bisected by at least two narrow panels defined by at least three spaced creases, a first bottom-side crease, a second top-side crease, and a third bottom-side crease, said pagestop-bookshelf panel terminating in an end flap panel, said pagestop-bookshelf panel foldable so that its narrow panels are insertable through said tray panel slot, said pagestop-bookshelf panel shaped so as to prevent relative lateral movement upon insertion thereof into said slotted tray panel.

2. The device as recited in claim 1, wherein said second portion and fourth portion contain at least two centrally spaced holes cut therethrough and are contiguous when said portions are folded and affixed.

3. The device as recited in claim 1, wherein said end flap panel of the pagestop-bookshelf panel contains two centrally spaced slots located adjacent said end flap panel's sides for the attachment therethrough of an elastic band or like object.

4. The device as recited in claim 3, further comprising means to attach an elastic band for holding the device in a collapsed portable position.

5. A multiple use study device for holding a plurality of articles comprising a single elongated blank of relatively stiff material scored along a plurality of transverse parallel lines so as to be foldable and to hingedly connect a plurality of panels at their contiguous edges, said blank having a first narrow end flap panel portion connected at one end by a first bottom-side crease to one end of a second panel portion, said second portion containing a centrally located, transverse slot, said second portion having outwardly extending tabs at its respective sides each of which contain double top-side creases scored in parallel alignment with said first panel portion's sides, said second portion's other end connected to one end of a third panel portion by a second bottom-side crease, said third portion containing a third top-side crease with its other end connected to one end of a fourth panel portion by a fourth top-side crease, said fourth portion containing a centrally located slot cut therethrough, said fourth portion slot located in parallel and longitudinal alignment with said second portion slot, said second portion's top side permanently attachable to to said fourth portion's top side to form a double thickness tray panel wherein said second portion slot is contiguous with said fourth portion slot, said tray panel reinforced with a third thickness at its sides by said second panel's tabs permanently attachable to said tray panel's bottom side, said tray panel structure further reinforced by a triangular tubelike configuration through its forward end formed from said third panel portion, its other end containing a fifth top-side crease which connects to one end of a rearwardly inclinable back panel, said first narrow end flap panel portion overlapping and permanently attachable to one end of said back panel's top side, wherein said first crease is contiguous with said fifth crease, said back panel's other end connected to one end of a forwardly inclinable prop panel by a narrow panel defined by a pair of spaced bottom-side creases, said prop panel terminating at its other end in a bottom-side crease which connects to one end of a base panel, said base panel bisected with a narrow panel defined by a pair of spaced top-side creases thus permitting said base panel to be collapsible, said base panel terminating at its other end in outwardly extending, laterally inwardly directed cuts from said blank's sides to connect with one end of an outwardly extending, parallel sided, pagestop-bookshelf panel, said pagestop-bookshelf panel laterally bisected by at least two narrow panels defined by at least three spaced creases, a first bottom-side crease, a second top-side crease, and a third bottom-side crease, said pagestop-bookshelf panel terminating in an end flap panel, said pagestop-bookshelf panel foldable so that its narrow panels are insertable through said tray panel slot, said pagestop-bookshelf panel shaped so as to prevent relative lateral movement upon insertion thereof into said slotted tray panel.

6. The device as recited in claim 5, wherein said second portion and fourth portion contain at least two centrally spaced holes cut therethrough and are contiguous when said portions are folded and affixed.

7. The device as recited in claim 5, wherein said end flap panel of the pagestop-bookshelf panel contains two centrally spaced slots located adjacent said end flap panel's sides for the attachment therethrough of an elastic band or like object.

8. The device as recited in claim 7, further comprising means to attach an elastic band for holding said device in a collapsed portable position.

* * * * *